US006886621B1

(12) United States Patent
Hesterberg et al.

(10) Patent No.: US 6,886,621 B1
(45) Date of Patent: May 3, 2005

(54) SPRUE FOR A LOST FOAM CASTING SYSTEM FOR BIASING A DIRECTIONAL FILL RATE FROM A BOTTOM PORTION OF A METAL CASTING

(75) Inventors: William G. Hesterberg, Rosendale, WI (US); Dean A. Wickman, Green Lake, WI (US); Thomas D. Blum, Fond du Lac, WI (US); Howard W. Beumler, Jr., Fond du Lac, WI (US)

(73) Assignee: Brunswick Corp., Lake Forest, CA (US)

( * ) Notice: Subject to any disclaimer, the term of this patent is extended or adjusted under 35 U.S.C. 154(b) by 0 days.

(21) Appl. No.: 10/230,588

(22) Filed: Aug. 29, 2002

(51) Int. Cl.[7] ..... B22C 9/04; B22C 7/02

(52) U.S. Cl. ..... 164/45; 164/35; 164/34; 164/244

(58) Field of Search ..... 164/34, 35, 45, 164/244, 246

(56) References Cited

U.S. PATENT DOCUMENTS

| | | | | | |
|---|---|---|---|---|---|
| 1,027,042 | A | * | 5/1912 | Golden | 164/244 |
| 4,240,493 | A | * | 12/1980 | Wilmarth | 164/35 |
| 4,300,617 | A | * | 11/1981 | Bauer | 164/244 |
| 4,721,149 | A | | 1/1988 | Hesterbert et al. | 164/244 |
| 4,766,942 | A | * | 8/1988 | Wessman et al. | 164/34 |
| 4,802,447 | A | | 2/1989 | Corbett | 123/65 |
| 4,966,220 | A | | 10/1990 | Hesterberg et al. | 164/34 |
| 5,038,847 | A | | 8/1991 | Donahue et al. | 164/112 |
| 5,355,930 | A | | 10/1994 | Donahue et al. | 164/34 |
| 5,355,931 | A | | 10/1994 | Donahue et al. | 164/34 |
| 5,518,060 | A | | 5/1996 | Cleary et al. | 164/45 |
| 5,960,851 | A | | 10/1999 | Donahue | 164/34 |

FOREIGN PATENT DOCUMENTS

| | | | |
|---|---|---|---|
| JP | 64-31550 | * | 2/1989 |
| JP | 6-55241 | * | 3/1994 |
| JP | 6-226422 | * | 8/1994 |

* cited by examiner

*Primary Examiner*—Kiley S. Stoner
*Assistant Examiner*—Len Tran
(74) *Attorney, Agent, or Firm*—William D. Lanyi; Andrus, Sceales, Starke & Sawall, LLP

(57) ABSTRACT

A sprue structure is specifically designed to facilitate the rapid filling of molded polystyrene patterns with molten metal. It comprises a down sprue and parallel columnar members that are connected to the down sprue. The flow of molten metal is initially downward through the first columnar member and then it reverses direction to flow upwardly through second and third columnar members so that the patterns to be cast receive molten metal as it travels upwardly through the second and third columnar members. This decreases the amount of pyrolyzation products that could otherwise flow through in-gates and into the patterns to be cast.

5 Claims, 5 Drawing Sheets

SPRUE FOR A LOST FOAM CASTING SYSTEM FOR BIASING A DIRECTIONAL FILL RATE FROM A BOTTOM PORTION OF A METAL CASTING

BACKGROUND OF THE INVENTION

1. Field of the Invention

The present invention is generally related to a sprue for a lost foam casting system and, more particularly, to a sprue that directs the flow of molten metal in a preferred direction from bottom to top in order to improve the quality of a metal casting made by a high pressure casting system.

2. Description of the Prior Art

The lost foam casting process, using evaporative foam patterns, is well known to those skilled in the art. U.S. Pat. No. 4,721,149, which issued to Hesterberg et al on Jan. 26, 1988, discloses a lost foam casting system with a high yield sprue. The system includes a sprue having a receiving portion for receiving molten metal from a source, a distribution portion with a plurality of radial fingers for distributing the molten metal radially outwardly, and a lower section having a plurality of feed passages receiving molten metal from the respective radial fingers and interconnected by thin flat support walls providing a relatively rigid structure. Work pieces and in-gates are connected to the flat exterior surfaces of the lower section of the sprue and fed with molten metal from respective feed passages. The structure provides pattern assembly rigidity, excellent dimensional control, high casting yield, high ratio of casting weight to gating/sprue weight, high surface area to volume ratio facilitating escape of vapor and organic effluents, ease of pattern attachment by large outer flat sprue surfaces, accessibility of casting for ease in removal from the sprue, low total volume for reduction of buoyancy, and faster metal fill rates and faster cooling.

U.S. Pat. No. 5,518,060, which issued to Cleary et al on May 21, 1996, discloses a method of producing polymeric patterns for use in evaporable foam casting. A positive three-dimensional model of the metal part to be cast is made by a layered prototyping process in which layers of sheet material are bonded in superimposed relation and the contour of the part to be cast is cut into each layer as it is applied to preceding layers to provide the model. A metal, such as copper, is then deposited on the working surface of the model to provide a rigid self-supporting shell having a surface which is the negative image of the part to be cast. The shell, after separation from the model, is then mounted in a die casting mold with the negative surface bordering a die cavity. Beads of a polymeric material, such as polystyrene, are introduced into the die cavity and heated to fuse the beads and provide a foam pattern which is identical in configuration to the metal part to be ultimately cast.

U.S. Pat. No. 4,802,447, which issued to Corbett on Feb. 7, 1989, discloses a foam pattern for an engine cylinder block. A polystyrene foam pattern is provided for the cylinder block of a crankcase compression two-cycle engine having transfer passages formed in the block. The pattern includes a head-end component and a crankcase end component mating with each other. The mating surfaces extend through the transfer ports, transfer passages, and exhaust ports to allow the formation of complex passages with die cast pattern components.

U.S. Pat. No. 4,966,220, which issued to Hesterberg et al on Oct. 30, 1990, discloses an evaporable foam casting system utilizing a hypereutectic aluminum-silicon alloy. The method of casting utilizes an evaporable foam system with a hypereutectic aluminum silicon alloy. The molten alloy is introduced into a mold in contact with an evaporable foam pattern formed of polystyrene, or the like. The heat of the molten alloy will decompose and vaporize the pattern and the vapor will enter the interstices of the surrounding sand, while the molten alloy will fill the void caused by the vaporization of the pattern. By casting the molten alloy into contact with the evaporable foam material, a more uniform distribution of primary silicon is obtained in the cast alloy and the heat of crystallization caused by precipitation of silicon crystals on solidification of the alloy will temporarily slow the solidification rate of the alloy, thus increasing the time for elimination of pattern residue vapors from the molten alloy.

U.S. Pat. No. 5,038,847, which issued to Donahue et al on Aug. 13, 1991, discloses an evaporable foam pattern for use in casting a crankshaft. A pattern for use in casting a rotatable shaft, such as a crankshaft for an internal combustion engine is disclosed. The pattern includes an evaporable foam pattern section composed of a material such as polystyrene and having a configuration conforming to the crankshaft to be cast. The evaporable foam pattern section includes a plurality of cranks connected by bearing areas, and tubular metal inserts formed of bearing quality steel which are disposed around each bearing area and around the pin areas of the cranks. In the casting process, the pattern is placed in a mold and surrounded with a finely divided material such as sand. When molten ferrous metal is fed into contact with the pattern, the pattern will vaporize with the vapor passing into the interstices of the sand while the molten ferrous metal will occupy the void created by the vaporized foam to produce a cast crankshaft having bearing quality steel inserts at the bearing and pin areas.

U.S. Pat. No. 5,355,930, which issued to Donahue et al on Oct. 18, 1994, discloses a method of expendable pattern casting of hypereutectic aluminum-silicon alloys using sand with specific thermal properties. A method of producing a casting utilizing an expendable polymeric foam pattern along with unbonded sand having specific thermal properties is disclosed. The pattern, formed of a material such as polystyrene, has a configuration corresponding to that of the article to be cast. The pattern is placed within an outer flask and unbonded sand surrounds the pattern as well as filling the cavities in the pattern. The sand has a specific heat diffusivity greater than a preselected magnitude. The molten hypereutectic aluminum silicon alloy is fed into the flask in contact with the pattern causing the pattern to vaporize with the vapor being entrapped within the interstices of the sand while the molten metal fills the space initially occupied by the foam pattern to produce a cast article. The thermal properties of the sand reduces the particle size of the precipitated primary silicon particles in the casting, thereby increasing the machinability of the casting.

U.S. Pat. No. 5,355,931, which issued to Donahue et al on Oct. 18, 1994, discloses a method of expendable pattern casting using sand with specific thermal properties. A method of producing dimensionally predictable metal castings utilizing an expendable polymeric foam pattern along with unbonded sand having specific thermal properties is disclosed. The pattern, formed of a material such as polystyrene, has a configuration corresponding to that of the article to be cast. The pattern is placed within an outer flask and unbonded sand surrounds the pattern as well as filling the cavities in the pattern. The sand has a linear expansion of less than a preselected magnitude, a heat diffusivity greater than a preselected magnitude, an AFS grain fineness number within a preselected range, and an AFS base permeability number within a preselected range. A molten metal, such as an aluminum alloy or a ferrous alloy, is fed into the mold in contact with a pattern causing the pattern to vaporize with the vapor being entrapped within the interstices of the sand while the molten metal fills the space initially occupied by the foam pattern to produce a cast article. The physical properties of the sand enable articles to be cast having more precise and predicable tolerances.

U.S. Pat. No. 5,960,851, which issued to Donahue on Oct. 5, 1999, discloses a method of lost foam casting of aluminum-silicon alloys. An improved method of lost foam casting of aluminum silicon alloys utilizes a pattern formed of an expendable polymeric foam having a decomposition temperature less than 300° C., and a heat of decomposition less than 600 Joules per gram. The foam pattern preferably has a heat of fusion less than 60 Joules per gram and a bulk density in the range of one to four pounds per cubic foot. The lost foam casting procedure has a particular use when casting a hypereutectic aluminum silicon alloys containing from 16 to 30% silicon, and eliminates the "liquid styrene" defect which occurs when casting such alloys in a lost foam process utilizing conventional polystyrene foam patterns. When casting hypoeutectic aluminum-silicon alloys containing from 5% to 8% silicon, the method eliminates the "fold" defect.

U.S. patent application Ser. No. 09/843,184, which was filed on Apr. 26, 2001, by Donahue et al, discloses method and apparatus for casting of metal articles using external pressure. A method and apparatus for casting of metal articles using external pressure and having particular application to lost foam casting of metal articles is disclosed. A polymeric foam pattern having a configuration corresponding to an article to be cast is placed in an outer flask and the pattern is connected through a polymeric foam gating system to a pouring cup located at the upper end of the flask. The pouring cup has a volume equal to 5% to 75% of the combined volume of the gating system and pattern. A finely divided inert material, such as sand, is placed in the flask surrounding the pattern and fills the internal cavities within the pattern. The flask containing the pattern is then positioned in an outer pressure vessel having a removable lid and a molten metal is fed into the pouring cup. The lid on the pressure vessel is closed and an external gaseous pressure is applied to the molten metal in the pouring cup as the molten metal feeds through the gating system to the pattern and progressively ablates the polymeric foam material, with the gaseous products of decomposition passing into the interstices of the sand and the molten metal filling the void created by decomposition of the foam. By applying pressure to the molten metal during filling, the molten metal front is more stable and fewer casting defects arise.

The patents described above are hereby expressly incorporated by reference in the description of the present invention.

Those skilled in the art who practice the procedures of lost foam casting must be aware of certain potentially disadvantageous characteristics of the process and must design the sprue system and patterns for the article to be cast in order to avoid certain potential problems. For example, the lost foam pattern must be designed in such a way that the pyrolized products resulting from the melting and vaporization of the polystyrene material be accommodated in such a way that they are not excessively entrained within the cast article. In addition, cast articles that contain thick portions can result in a problem relating to voids caused by contraction as the thick portions of the cast article cool. If the in-gates are not sufficiently sized to maintain continual availability of molten metal as the thick portions of the cast article solidify, the resulting contraction of the thick portion can create voids, related to the density difference between liquid and solid metal, that are not able to be subsequently filled by a ready supply of molten metal.

It would therefore be significantly beneficial if an improved sprue could be provided for use in conjunction with lost foam casting of metal articles, particularly when high pressure is introduced during the casting process.

SUMMARY OF THE INVENTION

A sprue for a lost foam casting process, made in accordance with the present invention, comprises a first columnar member made of evaporative material. The first columnar member has a receiving end for receiving molten metal. It also has an outlet end at an opposite end of the first columnar member from the receiving end. The receiving end is shaped to be received in a funnel made of a fibrous ceramic material and provided to serve as a pouring basin. A second columnar member is made of an evaporative material and has a first inlet end. A first connection member is made of evaporative material and connected between the outlet end of the first columnar member and the first inlet end of the second columnar member. The second columnar member is attachable to a pattern of an object to be cast from the molten metal. The pattern is made of evaporative material. As a result of the structure of the present invention, molten metal is directed to flow from the receiving end to the outlet end of the first columnar member and, subsequently, through the first inlet end of the second columnar member before flowing into the pattern of the object to be cast from the molten metal.

In a particularly preferred embodiment of the present invention, it further comprises a third columnar member made of evaporative material and has a second inlet end. It also comprises a second connection member made of evaporative material and connected between the outlet end of the first columnar member and the second inlet end of the third columnar member. The third columnar member is attachable to the pattern of the object to be cast from the molten metal. The pattern is made of evaporative material. As a result of the present invention, molten metal is directed to flow from the receiving end to the outlet end of the first columnar member and subsequently through the first and second inlet ends of the second and third columnar members, respectively, before flowing into the pattern of the object to be cast from the molten metal.

In a preferred embodiment of the present invention, the direction in which the molten metal is directed to flow through the first columnar member is generally opposite to the direction in which the molten metal is subsequently directed to flow through the second columnar member. The evaporative material, in a particularly preferred embodiment of the present invention, is expanded polystyrene. However, it should be understood that other evaporative materials can be used in alternative embodiments. It should also be understood that in certain complex patterns, the pattern comprises several individual elements that are glued together with a binding material that is also melted and evaporated when subjected to contact with molten metal.

In a preferred embodiment, chaplets are attached between the first columnar member and both the second and third columnar members. The first columnar member, in a preferred embodiment of the present invention, has a first cavity extending along at least a portion of its length. The second and third columnar members are provided with second and third cavities, respectively, extending along at least a portion of their lengths. In a preferred embodiment of the present invention, the molten metal is aluminum.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
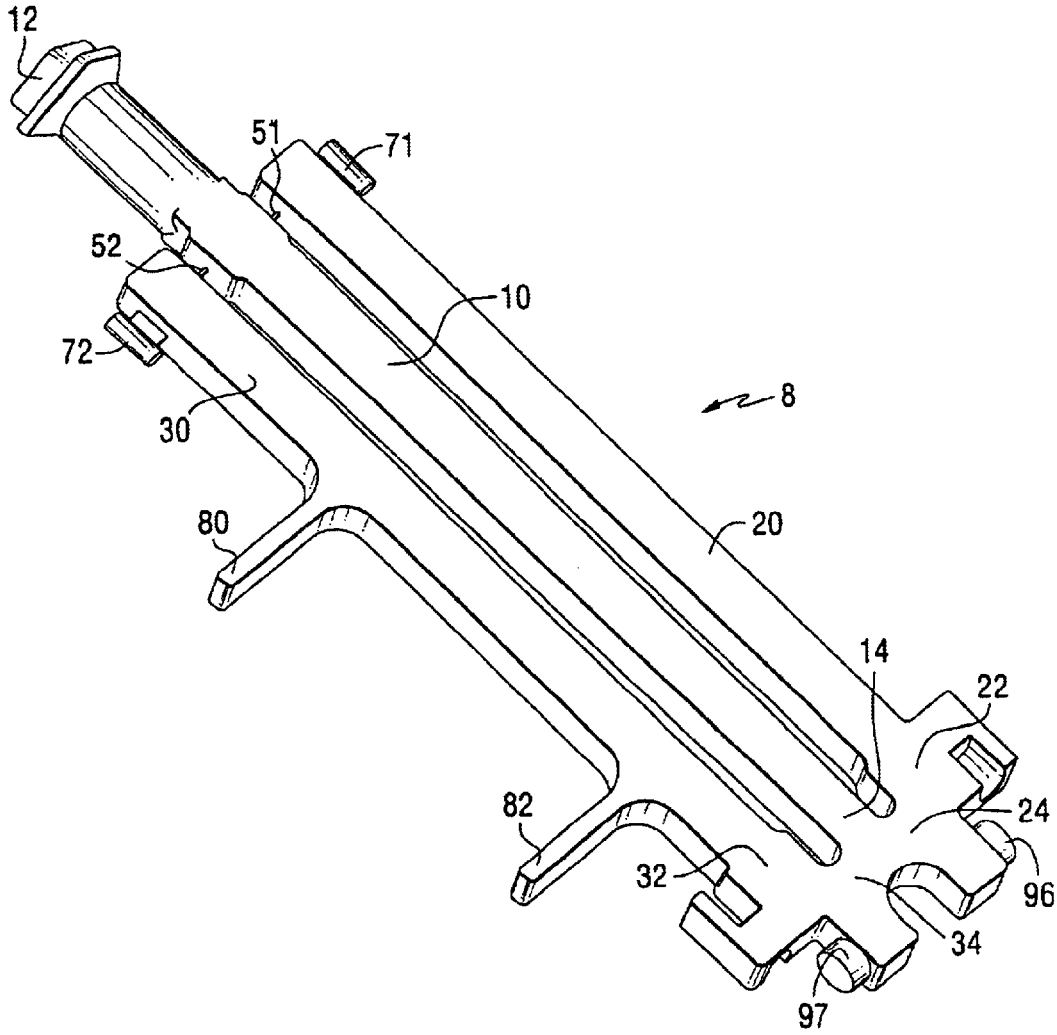
FIG. 1 is an isometric view of the present invention.

Throughout the description of the preferred embodiment of the present invention, like components will be identified by like reference numerals.

FIG. 1 is an isometric view of a sprue structure 8 for use in conjunction with a lost foam casting process. A first columnar member 10 is made of an evaporative material, such as expanded polystyrene. The first columnar member has a receiving end 12 and an outlet end 14. A second columnar member 20 has a first inlet end 22. A first connection member 24 is made of evaporative material and connected between the outlet end 14 of the first columnar member 10 and the first inlet end 22 of the second columnar member 20. A third columnar member 30 is made of evaporative material and has a second inlet end 32. A second connection member 34 is made of evaporative material and connected between the outlet end 14 of the first columnar member 10 and the second inlet end 32 of the third columnar member 30.

Figure 2:
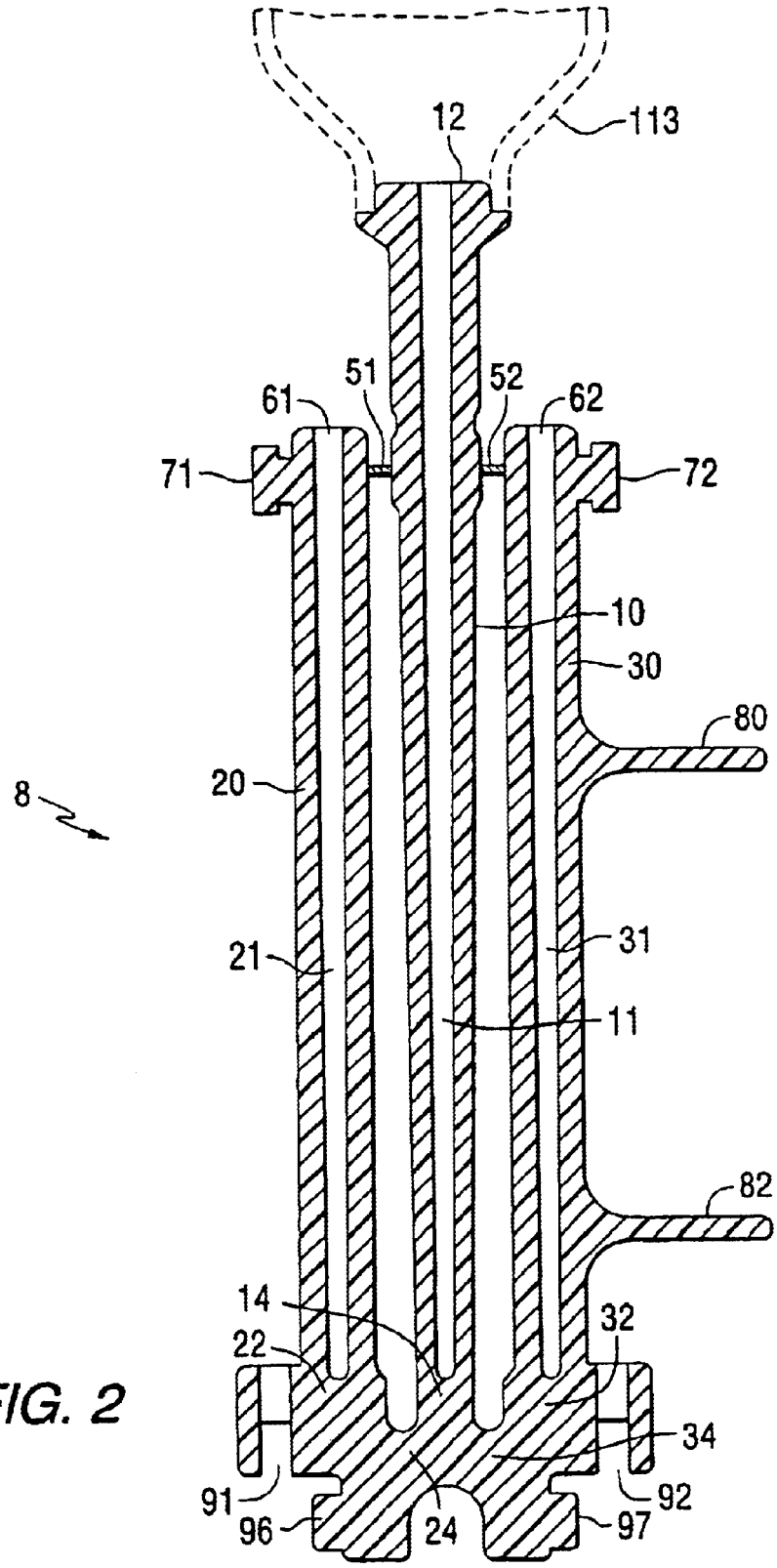
FIG. 2 is a section view of the present invention.

FIG. 2 is a section view taken through the structure of the sprue shown in FIG. 1. With reference to FIGS. 1 and 2, the first columnar member 10 has a first cavity 11 extending along at least a portion of its length. The second columnar member 20 has a second cavity 21 extending along at least a portion of its length. The third columnar member 30 has a third cavity 31 extending along at least a portion of its length.

With continued reference to FIGS. 1 and 2, the second and third columnar members, 20 and 30, are attachable to a pattern of an object to be cast from the molten metal. The pattern, as will be described in greater detail below, is made of evaporative material such as expanded polystyrene. As a result of the structure of the present invention, molten metal is directed to flow from the receiving end 12 of the first columnar member 10 to the outlet end 14 and subsequently through the first and second inlet ends, 22 and 32, of the second and third columnar members, 20 and 30, respectively. From the second and third columnar members, 20 and 30, the molten metal then flows into the pattern of the object to be cast. In other words, the molten metal flows downwardly through the first columnar member 10 before it is directed, by the first and second connection members, 24 and 34, to flow upwardly through the second and third columnar members, 20 and 30. As a result, the direction in which the molten metal is directed to flow through the first columnar member 10 is generally opposite to the direction in which the molten metal is subsequently directed to flow through the second and third columnar members, 20 and 30. As will be described in greater detail below, the in-gates that connect the pattern of the object to be cast are attached between the pattern of the object to be cast and the second and third columnar members, 20 and 30. Therefore, molten metal does not flow into the pattern of the object to be cast until after it is in the process of flowing upward through the second and third columnar members, 20 and 30.

With continued reference to FIGS. 1 and 2, first and second chaplets, 51 and 52, are attached between the first columnar member 10 and the second and third columnar members, 20 and 30, respectively. These chaplets are made of aluminum in a preferred embodiment of the present invention and comprise a rod-shaped center portion, which is visible in FIG. 2, and plate-like end portions that are embedded in the foam material of the three columnar members. The first and second chaplets, 51 and 52, therefore serve the purpose of maintaining the relative positions of the three columnar members with respect to each other.

The evaporative foam structure of the sprue device shown in FIGS. 1 and 2 also comprises several other elements that are beneficial. As illustrated in FIG. 2, the upper ends, 61 and 62, of the second and third columnar members, 20 and 30, are open as a result of the manufacturing technique used to produce the evaporative foam pattern of the sprue structure. That pattern is designed to result in the attached plug portions, 71 and 72, which can be easily detached from the main structure and inserted into the open ends, 61 and 62. This effectively plugs the upper ends of the cavities, 21 and 31, of the second and third columnar members, 20 and 30. Plugging the upper ends of these cavities prevents both slurry and sand from filling the cavities when the evaporative foam pattern is coated by slurry and then surrounded by sand during the subsequent casting procedure. Two extensions, 80 and 82, are formed as part of the third columnar member 30. These extensions are used to support the finished metal casting when the cast objects are removed from the sprue structure 8 by a sawing process. Two cylindrical openings, 91 and 92, are formed to receive pins of a locating structure during a process in which the evaporative foam pattern, comprised of the sprue and associated cast items, is coated with a wet ceramic coating such as mica or aluminum silicate. One material used in conjunction with the present invention is available in commercial quantity from Ashland Chemical and identified as EP9AL530FF. Also in FIGS. 1 and 2, two generally cylindrical extensions, 96 and 97, are formed as part of the sprue structure. These are useful in supporting the structure from a hanging fixture during the processing of the evaporative pattern prior to the metal casting process.

With continued reference to FIGS. 1 and 2, it can be seen that the sprue structure can be formed as a one piece molded polystyrene sprue element. As will be discussed below, polystyrene patterns are intended to be attached to the sprue structure. The cavities, 11, 21, and 31, facilitate rapid filling of the three columnar members, 10, 20, and 30. The first columnar member 10 operates as a down sprue and the first cavity 11 allows it to be rapidly filled to its bottom portion at its outlet end 14 with molten metal. The second and third columnar members, 20 and 30, operate as twin vertical runner bars to facilitate the rapid and uniform upward delivery of molten metal to the in-gates which subsequently conduct the molten metal into the polystyrene pattern of the components to be cast. The receiving end 12 of the first columnar member 10 is shaped to be received by an opening in an insulating ceramic fiber pouring basin 113. Since the present invention is particularly intended for use with a pressurized lost foam casting system, as disclosed in patent application Ser. No. 09/843,184 which is described above, a relatively large insulating pouring basin 113 performs the valuable function of holding a sufficiently large quantity of molten metal as the pressure containers are closed, sealed, and pressurized as the molten metal continues to flow into the receiving end 12 and subsequently through the first, second, and third columnar members.

Attaching the polystyrene pattern of the component to be cast to both the second and third columnar members achieves additional rigidity and spatial stability in combination with the chaplets, 51 and 52.

The single structure shown in FIGS. 1 and 2 performs multiple functions in addition to creating the sprue paths described above. The two plugs, 71 and 72, are removable from their positions shown in FIGS. 1 and 2 and insertable into the two open ends, 61 and 62, of the second and third columnar members, 20 and 30. This blocks the open ends, 61 and 62, to prevent either slurry or sand from entering the second or third cavities, 21 and 31. The two extensions, 80 and 82, serve to facilitate a later sawing operation during which the two finished cast products are removed from the sprue structure 8. Generally cylindrical openings, 91 and 92, are provided for an alignment device during the slurry coating process and cylindrical extensions, 96 and 97, are shaped to cooperate with a hanging clip that carries the polystyrene structure on a conveyor line prior to the casting process.

With particular reference to FIG. 2, the flow of molten metal begins when a quantity of the metal is poured into the insulating ceramic fiber pouring basin which is disposed in contact with the receiving end 12 of the first columnar member 10. The molten metal flows downwardly through the first columnar member 10 very quickly because of the existence of the first cavity 11. Although not limiting to the scope of the present invention, it should be understood that molten aluminum typically causes the polystyrene to evaporate at a rate which allows molten aluminum to flow at a velocity of approximately one inch per second when no cavity 11 is provided. However, when a cavity is provided, the molten aluminum flows at a rate of approximately 10 inches per second. Therefore, because of the provision of the first cavity 11 in the first columnar member 10, the molten metal flows rapidly downward through the cavity 11 and also through the surrounding polystyrene foam of the first columnar member. The molten member quickly reaches the outlet end 14 of the first columnar member and begins to melt and evaporate the polystyrene foam of the first and second connection members, 24 and 34. Since the first cavity 11 does not extend completely into the lowest region of the sprue structure 8, the melting and evaporation of the polystyrene foam in this lowest region is slower than the speed at which the first columnar member 10 was filled with molten metal.

With continued reference to FIG. 2, the molten metal initially begins to fill the lowest portion of the sprue structure 8 and then begins to upwardly fill the second and third columnar members, 20 and 30. The second and third cavities, 21 and 31, facilitate this filling in an upward direction and allow for a faster filling than solid columnar members would. It should be understood that as the molten metal moves upwardly through the second and third columnar members, 20 and 30, it sequentially reaches the in-gates that connect the second and third columnar members to the pattern of the component to be cast. As the molten metal sequentially reaches these gates, it flows through the structure of the in-gates while melting and evaporating the styrofoam material of the in-gates. Eventually, the molten metal rises upwardly through the length of the second and third columnar members, 20 and 30, and flows horizontally through all of the in-gates to completely fill the polystyrene pattern of the component to be cast.

It is important to realize that the melting and evaporation of the polystyrene material creates pyrolyzed products that result from the melting and vaporization of the polystyrene material. These pyrolyzed products can be both liquid and gaseous. Most of the pyrolyzed products flow through the pattern coating and into the sand which surrounds the original polystyrene structure as the molten metal replaces the polystyrene material. The vapor and organic effluents that result from the melting and vaporization of the polystyrene material are much lighter than the molten metal and, therefore, these effluents are buoyant in the molten metal. Therefore, as the molten metal passes downwardly through the first columnar member 10, the effluents tend to flow upwardly against the direction of flow of the molten metal. As a result, the molten metal may carry some of these effluents with it as it flows through the space previously occupied by polystyrene material. However, if the molten metal is flowing upwardly, the buoyant effluents tend to remain above the front face of the molten metal. This reduces the likelihood that the effluents will be mixed with the molten metal to possibly create a defective portion of the cast structure. As can be seen in FIG. 2, the molten metal is flowing upwardly in the second and third columnar members, 20 and 30, prior to its flowing through the in-gates and into the cast patterns, as will be described below.

Figure 3:
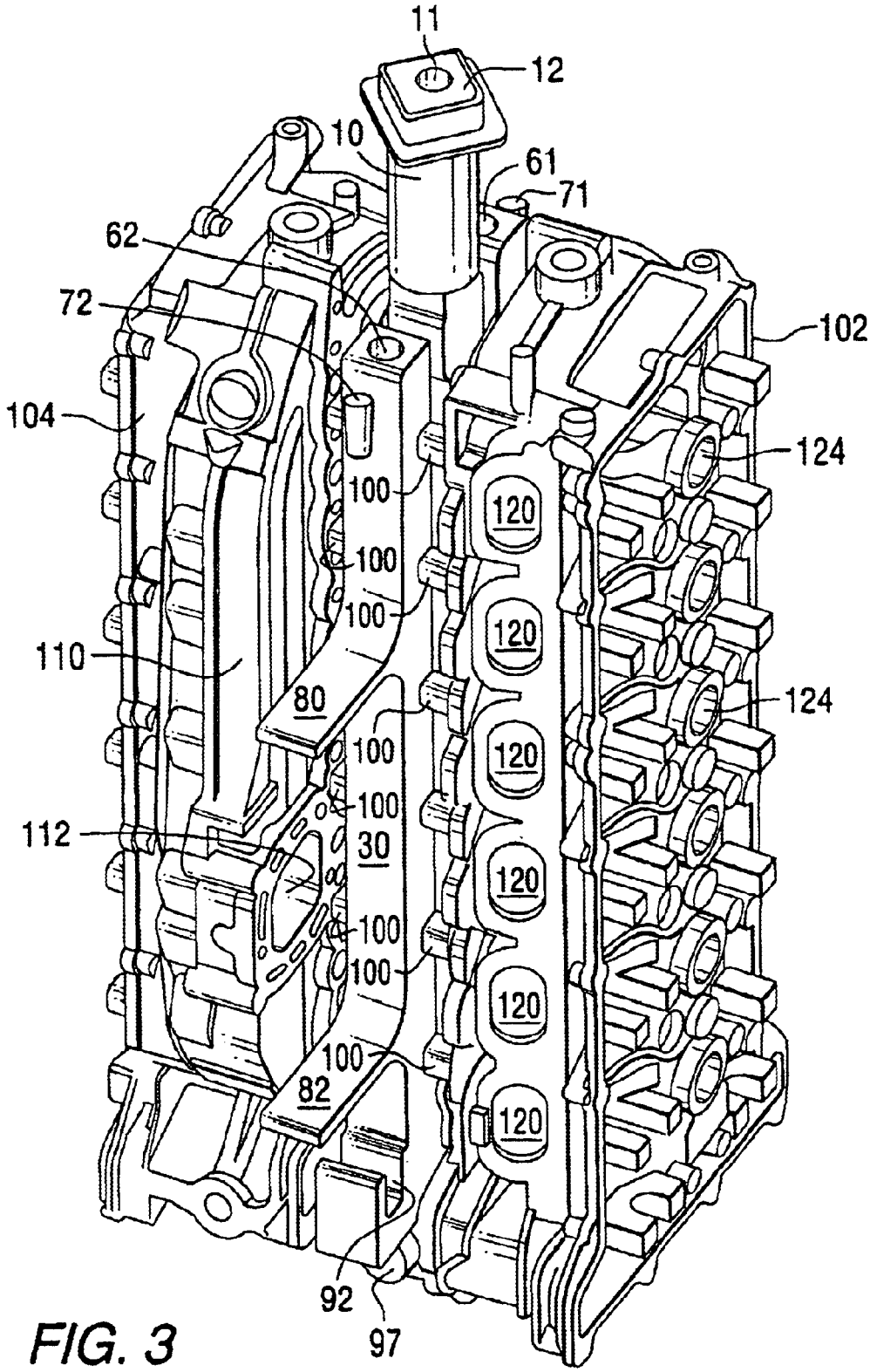
FIG. 3 is an isometric view of the present invention attached to two molded polystyrene patterns of cylinder heads.

FIG. 3 is an isometric view of the sprue structure of the present invention with two expanded polystyrene cylinder head patterns attached to it. Each of the cylinder head patterns comprises six pairs of in-gate elements 100 that are glued to the surfaces of the second and third columnar members. For purposes of references, the two cylinder head patterns are identified by reference numerals 102 and 104. The visible side of cylinder head pattern 104 shows the exhaust manifold 110 and an exhaust outlet 112. The visible side of cylinder head pattern 102 shows a plurality of intake passages 120 and a plurality of openings 124 which are each shaped to receive a spark plug. It should be understood that the particular component to be cast, such as the cylinder heads in FIG. 3, is not limiting to the scope of the present invention. The cylinder head patterns are illustrated in FIG. 3 for purposes of showing how the sprue structure of the present invention is utilized. Alternative components could replace the cylinder heads 102 and 104, in alternative applications of the present invention.

Also shown in FIG. 3, for purposes of facilitating reference to FIGS. 1 and 2 are the extensions, 80 and 82, the openings, 61 and 62, and the plugs, 71 and 72. The isometric view in FIG. 3 is of a molded polystyrene sprue, with two molded polystyrene patterns of components to be cast. Prior to the dipping of the structure into the slurry for purposes of coating the entire structure, the plugs, 71 and 72, would be detached from the positions shown in FIG. 3 and inserted into the openings, 61 and 62. This would be done in order to prevent the slurry from flowing downwardly into the second and third cavities, 21 and 31. A temporary cap, not shown in FIG. 3, would be used to cover the receiving end 12 of the first columnar member 10 to prevent the slurry from flowing downwardly into the first cavity 11.

With continued reference to FIG. 3, the structure shown is manufactured by gluing two previous manufactured molded polystyrene patterns for the cylinder heads, 102 and 104, to the previously manufactured sprue structure 8 which was described above in conjunction with FIGS. 1 and 2. Subsequent to that gluing operation, the structure shown in FIG. 3 becomes a unitary component that is subsequently dipped into a water based refractory slurry, dried, and then disposed in a flask. It is then provided with a pouring cup, surrounded by sand, and molten metal is poured into the receiving end 12.

Figure 4:
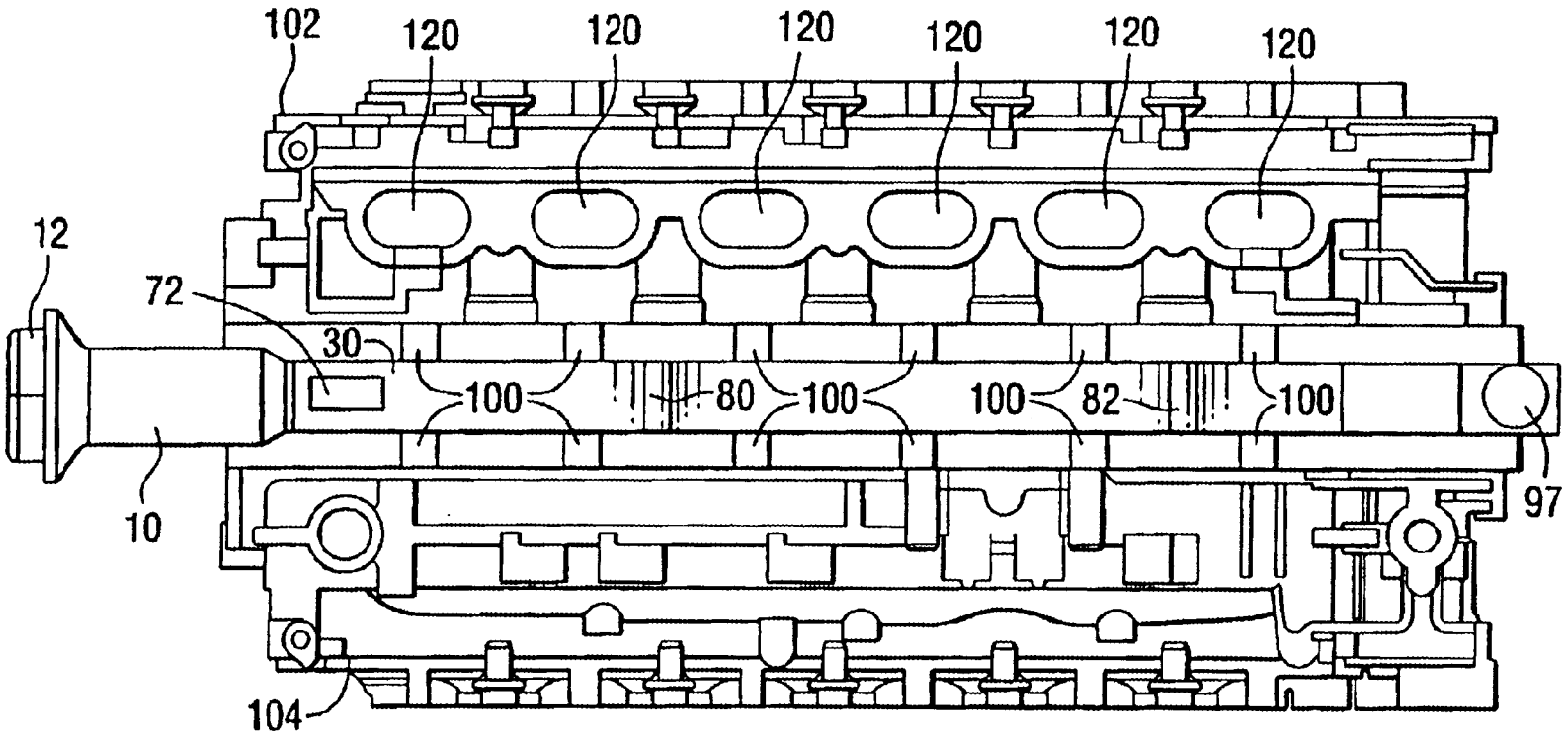
FIG. 4 is an end view of the structure shown in FIG. 3.

FIG. 4 is a side view of the assembly shown in FIG. 3. For purposes of reference, the extensions, 80 and 82, the cylindrical member 97, the intake ports 120, and the plug 72 are identified by their reference numerals to facilitate comparison of FIGS. 3 and 4.

The in-gates 100 are shown connecting each of the two cylinder heads, 102 and 104, to the surfaces of the second and third columnar members, 20 and 30, even though the view in FIGS. 3 and 4 only show the third columnar member 30.

Figure 5:
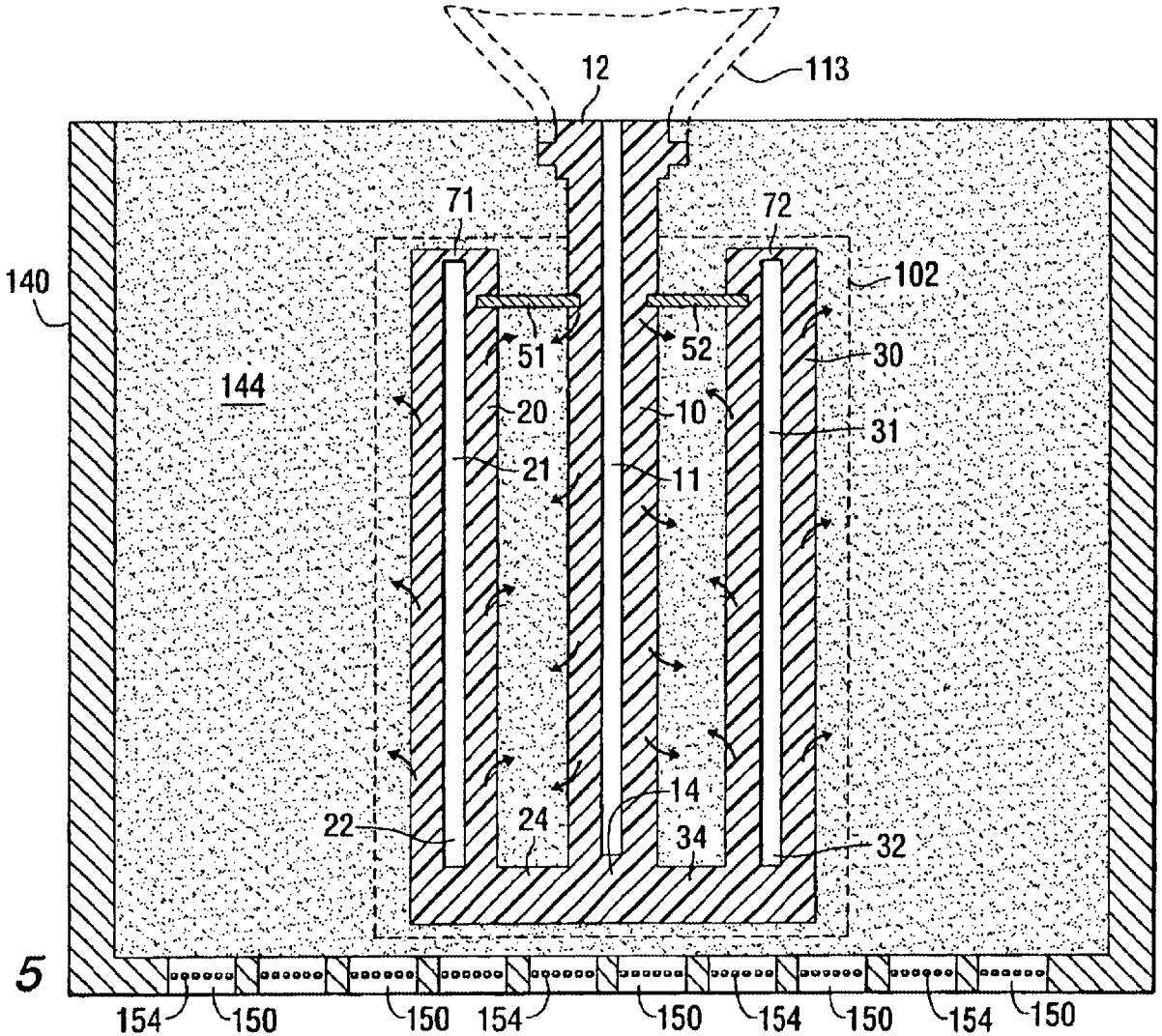
FIG. 5 is a highly schematic representation illustrating the use of the present invention in conjunction with a high pressure lost foam casting process.

FIG. 5 is a schematic representation of one exemplary process with which the present invention can be used. In FIG. 5, the sprue structure 8 is shown in a section view taken through the central portions of all three columnar members and through the two chaplets, 51 and 52. It should be understood that the illustration in FIG. 5 is provided for the purpose of showing the use of the present invention in conjunction with other equipment that is used in the casting process. One of the cylinder heads 102 is represented by a dashed line to illustrate the position, behind the sprue structure 8, in the section view of FIG. 5. A flask 140 is provided and the assembled component, as shown in FIGS. 3 and 4, is suspended within the internal cavity of the flask 104. A quantity of sand 144 is dispersed into the internal cavity of the flask 140 to surround the sprue structure and its attached components to be cast. An insulating ceramic fiber pouring basin 113 is attached to the receiving end 12 at the top of the first columnar member 10. The flask 140 is provided with a plurality of openings 150 in order to allow the internal cavity of the flask 140 to be pressurized. A screen structure 154 is used to prevent the sand 144 from flowing out of the cavity of the flask 140 through the openings 150. It should be understood that the openings 150 and the screen 154 are illustrated in a highly schematic manner. More details regarding the casting under pressure procedure are provided in patent application Ser. No. 09/843,184 which is described above.

With continued reference to FIG. 5, molten metal is poured into the insulating ceramic fiber pouring basin 113 at the top of the structure. The molten metal quickly flows into the receiving end 12 of the first columnar member 10 and downwardly through the first cavity 11. As the first cavity 11 is filled with molten metal, the metal melts and vaporizes the surrounding walls of polystyrene that form the first columnar member 10. The vapor and organic effluents resulting from the pyrolyzed polystyrene can flow through the slurry coating and into the sand which completely surrounds the first columnar member 10. Some of the effluent may be carried through the space previously occupied by the molded polystyrene of the first columnar member 10. Eventually, the molten metal reaches the outlet end 14 of the first columnar member 10 and begins to melt and vaporize the molded polystyrene material of the first and second connection members, 24 and 34. The molten metal then begins to flow upwardly into the second and third columnar members, 20 and 30, beginning at their first and second inlet ends, 22 and 32 respectively. The second and third cavities, 21 and 31, facilitate the upward movement of molten metal. The arrows in FIG. 5 generally represent the directions of flow of the vapor and organic effluents resulting from the pyrolyzed molded polystyrene as the molten metal continues to flow upwardly through the second and third columnar members, 20 and 30. Although not shown in FIG. 5, it should be understood that the molten metal sequentially reaches each of the plurality of in-gates 100 that are described above in conjunction with FIGS. 3 and 4. As this happens, the molten metal flows into the molded polystyrene pattern of the two cylinder heads, 102 and 104. Any remaining vapor and organic effluent will tend to flow upwardly through the second and third cavities, 21 and 31, ahead of the flow of molten metal because of the buoyancy of these products of pyrolyzation of the molded polystyrene. Any remaining effluent will tend to congregate at the upper extreme ends of the second and third columnar members, 20 and 30, in the region where the two plugs, 71 and 72, are located. The structure of the sprue system of the present invention inhibits the flow of these effluents into the actual casting of the components to be cast such as the cylinder heads, 102 and 104.

With reference to FIGS. 1–5, the gating system of the present invention has been demonstrated to provide low volume fraction voids and consistent mechanical properties when used to cast complicated configurations, such as the exemplary cylinder heads, through the use of a lost foam casting process which utilizes pressure during the solidification phase. The sprue structure of the present invention facilitates solidification of the casting within a pressure vessel, such as the flask 140, when pressures up to and including ten atmospheres are used. The pressure is intended to suppress the equilibrium precipitation of hydrogen that is normally associated with the comparatively slow cooling sand castings as the molten metal, such as an aluminum alloy, changes state from liquid to solid. The sprue structure of the present invention facilitates the continued feeding of molten metal through the in-gates 100 during solidification. This prevents voids that could otherwise be caused by shrinking in certain thick sections of the components to be cast, particularly when the shrinking is not replaced with molten metal. Experience has indicated that the use of a pressure lost foam casting system, such as that disclosed in patent application Ser. No. 09/843,184, described above, may be more susceptible to this shrinkage problem within thick sections of the component to be cast than lost foam casting processes which are performed at atmospheric pressure.

It is important that the molten metal pass through the in-gates 100 with minimum turbulence and minimum interaction with the molded polystyrene foam pattern. This requires a relatively fast passage of the molten metal through the sprue structure and through the in-gates.

It is also important that interaction of the molten metal with the molded polystyrene material be minimized in order to prevent the otherwise present chaotic gas formation and resulting voids associated with this phenomenon. The present invention can be used with many different types of aluminum alloys and, more specifically, with aluminum alloy A356 which is used in many castings associated with internal combustion applications used in the marine industry.

Previously known gating systems typically use a "ladder gating" approach to deliver metal to the molded polystyrene pattern clusters. In this type of system, molten metal flows downwardly through a vertical sprue and then laterally feeds into the in-gates to fill the molded polystyrene patterns of the components to be cast. The down sprue can be partially hollow or solid. Some known systems utilize a bottom fill gating procedure, whereby metal is delivered to the underside of a pattern and subsequently introduced to the bottom of the pattern. In contradistinction to known systems, the sprue structure of the present invention provides a system that results in a bottom fill technique in a way that facilitates the greater demand for the feeding of additional molten metal that is imposed by the solidification of the molten metal under pressure. Correspondingly, the pressurized casting system requires that the formation of gaseous pattern pyrolyzation products are minimized and successfully managed to prevent those pyrolyzation products from being trapped within the components to be cast. It is important that the products of pyrolyzation are directed to flow to the surfaces of the space previously occupied by molded polystyrene material so that these pyrolyzed effluents can escape through the pattern coating into the surrounding mold media, such as sand 144, and therefore avoid the formation of organically related voids in the castings.

With continued reference to FIGS. 1–5, the present invention provides a first columnar member 10 that has an internal cavity 11. This allows the molten metal to rapidly reach the bottom of the first columnar member at its outlet end 14. This rapid flow of molten metal downwardly through the first cavity 111 minimizes the transmission of pyrolyzation products to the flow of molten metal. The second and third columnar members, 20 and 30, are also provided with cavities, 21 and 31, to facilitate their rapid and uniform filling with molten metal. This minimizes the transmission of pyrolyzation products to the in-gates 100. Most of the pyrolyzation products formed as a result of the melting and vaporization of the molded polystyrene float to the top of the vertical column of molten metal within the space previously occupied by the second and third columnar members, 20 and 30. From there it escapes harmlessly through the coating on the outer surfaces of the sprue pattern and into the mold media, such as sand 144. This avoids the flow of these effluents through the in-gates 100 where the pattern pyrolyzation products can otherwise produce defects in the components to be cast. The first and second connection members, 24 and 34, are sized to provide a sufficient volume to surface area ratio so that they appropriately feed the second and third columnar members, 20 and 30, with sufficient molten metal to feed the patterns of the components to be cast. The region at the bottom of the sprue structure, where the molten metal changes direction to flow from the first columnar member 10 into the second and third columnar members, 20 and 30, is provided with a sufficient radius to avoid turbulence of the molten metal as it turns upwardly to approach the in-gates 100. Metal chaplets, 51 and 52, are used to stabilize the position of the second and third columnar members relative to the first columnar member and relative to each other. In addition, the attachment of the molded polystyrene in-gates 100 provide rigidity and fix the relative positions of the second and third columnar members to each other. The sprue structure, in a preferred embodiment of the present invention, is a single piece design and is compact to conserve the polystyrene material. The first, second, and third cavities, 11, 21, and 31, also reduce the required amount of molded polystyrene in the sprue structure.

Although the present invention has been described with particular specificity and illustrated to show a preferred embodiment, it should be understood that alternative embodiments are also within its scope.

We claim:

1. A sprue for a lost foam casting process, comprising:

a longitudinally extending first member made of evaporative material, said first member having an upper receiving end for receiving molten metal, and a lower outlet end;

a longitudinally extending second member made of evaporative material, said second member having a lower inlet end;

a connection member made of evaporative material and laterally connected between said outlet end of said first member and said inlet end of said second member, said second member being attachable through at least one laterally extending in-gate to a pattern of an object to be cast from said molten metal, said pattern being made of evaporative material, whereby said molten metal is directed to flow from said upper receiving end of said first member of said sprue longitudinally downwardly through said first member of said sprue to said lower outlet end of said first member of said sprue then laterally through said connection member of said sprue to said lower inlet end of said second member of said sprue then longitudinally upwardly through said second member of said sprue to said in-gate then laterally through said in-gate to said pattern of said object to be cast.

2. The sprue accordingly to claim 1 wherein said evaporative material yields buoyant effluents upon vaporization thereof by said molten metal, said effluents rising upwardly against the downward flow of said molten metal through said first member of said sprue, said effluents rising upwardly with the upward flow of said molten metal through said second member of said sprue, and wherein said second member of said sprue extends longitudinally upwardly beyond said in-gate to an upper section permitting congregation of said effluents therein, such that said effluents may bypass said in-gate and instead flow to said upper section of said second member of said sprue, whereby to reduce effluent flow through said in-gate, to minimize defective cast objects otherwise caused by effluents mixed with said molten metal in said cast object.

3. The sprue according to claim 1 wherein said molten metal flows through said in-gate and into said pattern of said object to be cast only after said molten metal has flowed downwardly then upwardly through said sprue, namely downwardly through said first member of said sprue then upwardly through said second member of said sprue, prior to flowing laterally into said pattern through said in-gate.

4. The sprue according to claim 1 comprising a plurality of said in-gates longitudinally spaced along said second member of said sprue, wherein said molten metal sequentially reaches said in-gates in an upward flow of said molten metal from one in-gate to another in-gate thereabove.

5. The sprue according to claim 1 comprising:

a longitudinally extending third member made of evaporative material, said third member having a lower inlet end;

a second connection member made of evaporative material and laterally connected between said outlet end of said first member and said inlet end of said third member, said third member being attachable through at least one laterally extending second in-gate to a second pattern of a second object to be cast from said molten metal, said second pattern being made of evaporative material, whereby said molten metal is directed to flow from said upper receiving end of said first member of said sprue longitudinally downwardly through said first member of said sprue to said lower outlet end of said first member of said sprue then laterally through said first mentioned connection member of said sprue to said lower inlet end of said second member of said sprue then longitudinally upwardly through said second member of said sprue to said first mentioned in-gate then laterally through said first in-gate to said first mentioned pattern of said first mentioned object to be cast, and whereby said molten metal is also directed to flow from said upper receiving end of said first member of said sprue longitudinally downwardly through said first member of said sprue to said lower outlet end of said first member of said sprue then laterally through said second connection member of said sprue to said lower inlet end of said third member of said sprue then longitudinally upwardly through said third member of said sprue to said second in-gate then laterally through said second in-gate to said second pattern of said second object to be cast.

* * * * *